US005938357A

United States Patent [19]

Faraj

[11] Patent Number: 5,938,357

[45] Date of Patent: Aug. 17, 1999

[54] POSTAGE STAMP TOOL

[76] Inventor: Abdul-Razzak Faraj, P.O. Box 566068, Atlanta, Ga. 31156

[21] Appl. No.: 09/098,073

[22] Filed: Jun. 16, 1998

[51] Int. Cl.[6] ..... B43K 29/00; B43K 29/05

[52] U.S. Cl. ..... 401/18; 401/23; 401/52; 401/202

[58] Field of Search ..... 401/17, 18, 21, 401/23, 52, 202, 205

[56] References Cited

U.S. PATENT DOCUMENTS

| | | | |
|---|---|---|---|
| 460,602 | 10/1891 | Stevens | 401/17 |
| 2,354,402 | 7/1944 | Petruccione et al. | 401/18 X |
| 3,733,139 | 5/1973 | Neidhardt et al. | 401/18 |
| 5,007,756 | 4/1991 | Wey | 401/52 X |

FOREIGN PATENT DOCUMENTS

| | | | |
|---|---|---|---|
| 72772 | 2/1983 | European Pat. Off. | 401/17 |
| 16165 | 7/1911 | United Kingdom | 401/52 |

*Primary Examiner*—Steven A. Bratlie
*Attorney, Agent, or Firm*—John L. James

[57] ABSTRACT

A postage tool has three sections: A top section contains water for moistening a stamp or envelope, a second section stores postage stamps, and a third section provides a writing instrument for addressing envelopes. The three sections fit together to form a handy tool for addressing envelopes and affixing postage.

4 Claims, 1 Drawing Sheet

POSTAGE STAMP TOOL

FIELD OF THE INVENTION

The present invention relates to a tool for storing postage stamps, addressing envelopes and moistening envelope glue flaps and postage stamps.

BACKGROUND OF THE INVENTION

It is often necessary to address or mail envelopes and packages while away from the home or office where tools are readily available for addressing envelopes, sealing them and affixing postage stamps. The tongue can be used to moisten envelopes and affix postage stamps but is undesirable, not only because the glue is unpleasant and the tongue is sometimes too dry, but also because there is a danger of cutting the tongue with attendant risk of infection. Stamps carried in a purse or pocket often become soiled or contaminated making licking the stamp undesirable. Accordingly, it will be appreciated that it would be highly desirable to have a tool that can be used to store postage stamps, address envelopes and moisten both postage stamps and envelope glue flaps.

SUMMARY OF THE INVENTION

Briefly summarized, according to one aspect of the present invention, a postage tool contains three members connected together one atop the other. The first cylindrical member provides a reservoir for storing a wetting agent, and an applicator extending from the reservoir for dispensing the wetting agent on a glue flap or postage stamp. The second cylindrical member provides a postage stamp storage chamber that is accessible by removing the first member from atop the second member. The third member houses a writing tip.

One end of the postage tool is for writing while the other end is a moistener for moistening envelope glue flaps and postage stamps. This leaves the middle portion to provide a storage compartment for postage stamps. The result is one handy tool having everything needed to post a letter.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 2:
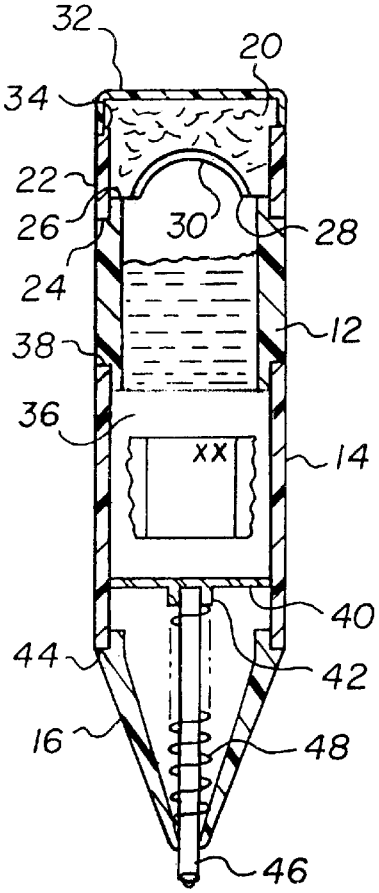
FIG. 2 is a longitudinal sectional view of the tool of FIG. 1.
Figure 1:
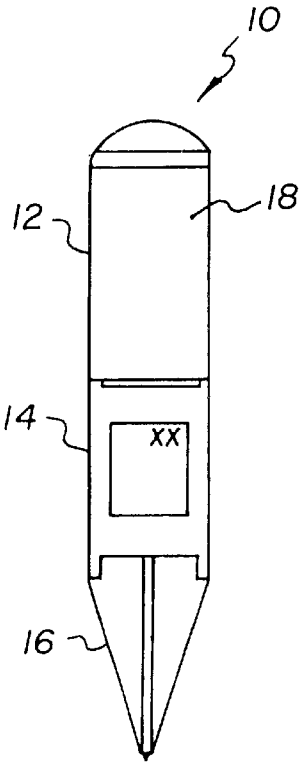
FIG. 1 is a diagrammatic front view of a preferred embodiment of a postage stamp tool incorporating a stamp holder, writing instrument and an envelope moistener according to the present invention.

Referring to FIGS. 1–2, a postage tool 10 has first and second cylindrical housing members 12, 14, and a third housing member 16 detachably joined to one another. The fit may be an interference fit where the members snap together, or may be a threaded fit where the members are mateably threaded. The fit is a release fit so that the members may be easily and repeatedly fitted together and taken apart, preferably using an interference fit or threads.

A reservoir 18 is formed in the first cylindrical housing member 12 for storing an agent, for affixing postage stamps and sealing envelope glue flaps, such as water, glue or other adhesive for example. Water is practical and easy to use where an envelope has a sealing flap with glue to be moistened or where the adhesive on a postage stamp is to be moistened prior to affixing on the envelope. In the absence of a glue flap, glue or other adhesive is required.

The wetting agent is dispensed via an applicator tip 20 constructed of an absorbent material, such as sponge rubber or felt, for example. The absorbent applicator tip 20 is in communication with the reservoir 18 from which it absorbs the wetting agent. The applicator extends from the top end of housing member 12 to facilitate depositing the wetting agent on the glue flap of the envelope, postage stamp or other receiving surface. The applicator tip 20 is housed in a holder 22 fitted onto the top end of the first cylindrical housing member 12. Preferably, housing member 12 has a shoulder 24 on which holder 22 sits. From the shoulder 24 to its top end, housing member 12 has a narrower outside diameter than at the remainder of the reservoir so that when holder 22 is attached the outside diameter of the tool is constant. The inside of holder 22 forms a second shoulder 26 with the top of first housing member 12 on which applicator tip 20 sits. Preferably, a plastic support member 28 rests on second shoulder 26 to support applicator tip 20 and regulate fluid flow through an opening or openings 30. Alternatively, applicator tip 20 could be formed of a material rigid enough to support itself on shoulder 26 while having a porosity that self regulates fluid flow similar to fibrous material used for writing and marking instruments. A cap 32 fits onto a shoulder 34 on the top end of the holder to cover applicator tip 20 and prevent evaporation and leakage of the wetting agent.

The second cylindrical member 14 has top and bottom portions and defines a postage stamp storage chamber 36 that is accessible through the top portion which is open. Second cylindrical member 14 is removably attached to the bottom portion first cylindrical member 12, and may be constructed of transparent material so that postage stamps are visible. Preferably, housing member 12 has a shoulder 38 on which second cylindrical member 14 sits. From the shoulder 38 to its bottom end, housing member 12 has a narrower outside diameter than at the remainder of the reservoir so that when second cylindrical member 14 is attached the outside diameter of the tool is constant. The bottom 40 of second cylindrical member 14 is closed and has an inverted cup 42 on its bottom side opening away from storage chamber 36.

The third member 16 also has top and bottom portions that are open. Preferably, housing member 16 has a shoulder 44 on which second cylindrical member 14 sits. The shoulder 44 is formed by reducing the outside diameter so that second housing member 14 sits on shoulder 44 outside the narrow diameter of third housing member 16. Housing member 16 tapers from shoulder 44 to its narrow bottom.

Figure 3:
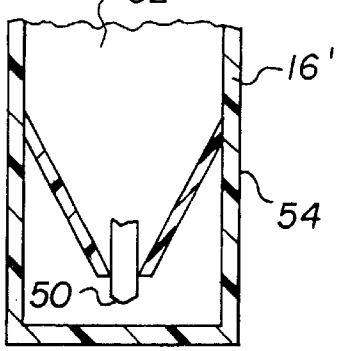
FIG. 3 is a sectional view of a writing tip portion of a postage tool similar to FIG. 2 but illustrating another preferred embodiment.

A ball point pen writing tip 46 has the ball point extending from the third member via the open bottom and has the distal end of ball point pen shaft abutting the inverted cup 42 to provide a writing instrument. A coil spring 48 may be provided for the writing tip as is known in the art. FIG. 3 illustrates an alternative embodiment utilizing a fibrous tip writing element 50 receiving ink from a reservoir 52 in the third housing member. 16'. A fibrous tip can be advantageous because the thickness of characters printed can be varied by varying writing pressure. With a fibrous tip, an inverted cup is not required.

An end cap 54 is removably fitted on the third housing member 16 to cover the writing tip when the tip is not in use. Preferably, the cap sealingly engages the housing to inhibit evaporation of the writing fluid and to keep the tip moist and ready for use. The cap also protects pockets from stains if the ball point leaks.

Operation of the postage stamp tool is believed to be apparent from the foregoing description and drawings, but a few words will be added for emphasis. The tool is assembled by connecting the housing members, attaching the applicator and adding end caps. Water is added to the reservoir by removing the applicator holder which removes the applicator tip with it. Stamps are added or removed by removing the first cylindrical housing member from the second cylindrical housing member. The applicator tip is accessed by removing the end cap.

It can now be appreciated that a postage stamp tool has been presented that is shaped like a writing pen and may have a pen for writing on one end, a moistener on the other end, and a storage compartment for postage stamps in between. The tool is compact and easily transported in a purse or briefcase without danger of leaking ink or water.

While the invention has been described with particular reference to the preferred embodiments, it will be understood by those skilled in the art that various changes may be made and equivalents may be substituted for elements of the preferred embodiments without departing from invention. For example, the housing members may be joined by interference fit so that they snap together or may be joined using threads, or may use a combination of the two.

As is evident from the foregoing description, certain aspects of the invention are not limited to the particular details of the examples illustrated, and it is therefore contemplated that other modifications and applications will occur to those skilled in the art. For example, the first housing member can be constructed of transparent material so that the fluid level can be easily monitored. It is accordingly intended that the claims shall cover all such modifications and applications as do not depart from the true spirit and scope of the invention.

What is claimed is:

1. A postage tool, comprising:

a first cylindrical member having a top, middle and bottom portions and defining a reservoir for storing a wetting agent, said top and bottom portions being smaller in diameter than said middle portion, said top portion being joined to said middle portion and defining a first outside shoulder at the junction, said bottom portion being joined to said middle portion and defining a second outside shoulder at the junction;

a holder fitted onto said top end position of said first cylindrical member and resting on said first outside shoulder of said first cylindrical member, said holder and said top end portion of said first cylindrical member forming an inside shoulder;

a support member having an opening for regulating flow of said wetting agent and being seated on said first inside shoulder in said holder over said reservoir;

an applicator seated on said support member in said holder over said support member opening for withdrawing said wetting agent from said reservoir and depositing said wetting agent on a receiving surface;

a second cylindrical member having a top and bottom portions and defining a postage stamp storage chamber accessible through said top portion, said top portion of said second cylindrical member being removably attached to said bottom portion first cylindrical member;

a third member having a top and bottom portions, said top portion of said third member being removably attached to said bottom portion second cylindrical member;

a writing tip extending from said bottom portion of said third member;

a cap covering said writing tip to inhibit evaporation of writing fluid; and a cap fitted onto said holder and covering said applicator to inhibit evaporation of said wetting agent.

2. A postage tool, as set forth in claim 1, wherein said third member defines a second reservoir for storing a writing medium dispensable by said writing tip.

3. A postage tool, as set forth in claim 1, wherein said writing tip is a ball point supported on a shaft having a distal end abutting said bottom portion of said cylindrical member.

4. A postage tool, as set forth in claim 1, including a cap fitted onto a shoulder formed on a top of said holder.

* * * * *